US007340929B1

(12) United States Patent
Christopoulos

(10) Patent No.: US 7,340,929 B1
(45) Date of Patent: Mar. 11, 2008

(54) AXIALLY ROTATIVE REKEYABLE LOCK

(76) Inventor: Efthemois Christopoulos, 20 Elm St., Reading, MA (US) 01867

( * ) Notice: Subject to any disclaimer, the term of this patent is extended or adjusted under 35 U.S.C. 154(b) by 193 days.

(21) Appl. No.: 11/085,312

(22) Filed: Mar. 21, 2005

(51) Int. Cl.
*E05B 27/06* (2006.01)

(52) U.S. Cl. ..... 70/358; 70/337; 70/340; 70/369

(58) Field of Classification Search ..... 70/358, 70/367–369, 337–340
See application file for complete search history.

(56) References Cited

U.S. PATENT DOCUMENTS

| | | | | | |
|---|---|---|---|---|---|
| 666,697 | A | | 1/1901 | Roche | |
| 1,565,557 | A | * | 12/1925 | Fremon | 70/339 |
| 1,785,634 | A | * | 12/1930 | Lawrence | 70/340 |
| 2,097,192 | A | * | 10/1937 | Jacobi | 70/368 |
| 2,113,007 | A | * | 4/1938 | Swanson | 70/340 |
| 2,266,163 | A | | 12/1941 | Ching | |
| 2,422,600 | A | * | 6/1947 | Swanson | 70/340 |
| 2,603,081 | A | | 7/1952 | Pelle | |
| 3,191,407 | A | * | 6/1965 | Spon | 70/383 |
| 3,194,034 | A | * | 7/1965 | Leiser | 70/358 |
| 3,261,188 | A | | 7/1966 | Kerr | |
| 3,473,355 | A | * | 10/1969 | Saito | 70/339 |
| 4,185,480 | A | * | 1/1980 | Pechner | 70/358 |
| 4,372,139 | A | | 2/1983 | Laake | |
| 4,631,941 | A | * | 12/1986 | Sjunnesson | 70/337 |
| 4,669,288 | A | * | 6/1987 | Percebois et al. | 70/367 |
| 4,836,002 | A | * | 6/1989 | Monahan | 70/382 |
| 4,850,210 | A | | 7/1989 | Adler et al. | |
| 4,912,953 | A | | 4/1990 | Wobig | |
| 5,000,019 | A | * | 3/1991 | Foster | 70/338 |
| 5,046,342 | A | * | 9/1991 | Urby | 70/337 |
| 5,186,031 | A | * | 2/1993 | Janssen et al. | 70/277 |
| 5,325,690 | A | | 7/1994 | Adler et al. | |
| 5,685,184 | A | * | 11/1997 | Gallagher | 70/358 |
| 5,704,234 | A | * | 1/1998 | Resch | 70/371 |
| 5,752,400 | A | * | 5/1998 | Kim | 70/368 |
| 5,819,569 | A | | 10/1998 | Herdman | |
| 5,921,121 | A | | 7/1999 | Tang | |
| 6,119,495 | A | | 9/2000 | Loretti | |
| 6,776,017 | B2 | | 8/2004 | Herdman | |
| 7,104,098 | B2 | * | 9/2006 | Romero et al. | 70/224 |

* cited by examiner

*Primary Examiner*—Suzanne Dino Barrett
(74) *Attorney, Agent, or Firm*—Michael I. Kroll

(57) ABSTRACT

A lock apparatus able to be installed in a structure comprising an outer sleeve having a plurality of outer rows extending transversely therethrough and radially therearound and a first bore extending though substantially a center thereof. An inner sleeve having a second bore extending through substantially a center thereof and is releasably connected within the first bore. The inner sleeve includes a plurality of inner rows extending therethrough wherein each respective inner row is aligned with a respective one of the plurality of outer rows. A plurality of user selectable pin sets is positioned within the plurality of outer and inner rows. A lock core for receiving a key therein is releasably connected within the second bore and includes a core pin set wherein a respective one of the plurality of user selectable pin sets is aligned with the core pin set creating an active pin formulation. A means for changing said active pin formulation is connected within each of the core and the inner and outer sleeves for changing the active pin formulation.

10 Claims, 6 Drawing Sheets

AXIALLY ROTATIVE REKEYABLE LOCK

BACKGROUND OF THE INVENTION

1. Field of the Invention

The present invention relates generally to locks and, more specifically, to a rekeyable lock having a plurality of pin tumbler combinations that are user selective. Pin tumbler combinations are positioned around the keyway plug and allow any of the preset combinations to be selected. Accordingly, a key mating to each pin tumbler combination is required. To select a different pin tumbler combination, a master key is inserted into the keyway to enable rotation of an outer sleeve about the keyway plug thereby positioning a new set of pins into the keyway. The present invention allows the holder of the master key to change the lock without actually replacing the lock.

2. Description of the Prior Art

There are other rekeyable locks. Typical of these is U.S. Pat. No. 66,697 issued to Roche on Jan. 29, 1901.

Another patent was issued to Ching on Dec. 16, 1941 as U.S. Pat. No. 2,266,163. Yet another U.S. Pat. No. 2,603,081 was issued to Pelle on Jul. 15, 1952 and still yet another was issued on Jul. 19, 1966 to Kerr as U.S. Pat. No. 3,261,188.

Another patent was issued to Laake on Feb. 8, 1983 as U.S. Pat. No. 4,372,139. Yet another U.S. Pat. No. 4,850,210 was issued to Adler et al on Jul. 25, 1989. Another was issued to Wobig on Apr. 3, 1990 as U.S. Pat. No. 4,912,953 and still yet another was issued on Jul. 5, 1994 to Adler et al as U.S. Pat. No. 5,325,690.

Another patent was issued to Herdman on Oct. 13, 1998 as U.S. Pat. No. 5,819,569. Yet another U.S. Pat. No. 5,921,121 was issued to Tang on Jul. 13, 1999. Another was issued to Loreti on Sep. 19, 2000 as U.S. Pat. No. 6,119,495 and still yet another was issued on Aug. 17, 2004 to Herdman as U.S. Pat. No. 6,776,017. Another was issued to Horsey on Sep. 12, 1905 as U.K. Patent No. GB27,080 and still yet another was issued on Jun. 27, 2002 to Loreti as Bulgarian Patent No. BG63512.

U.S. Pat. No. 666,697

Inventor: James Roche

Issued: Jan. 29, 1901

A two-part lever-tumbler for a multiplekey lock, where the tumbler consists of a pivoted main part and a pivoted supplemental part, and said parts being adapted to be rigidly locked together in different relations to each other.

U.S. Patent Number 2,266,163

Inventor: John F. Ching

Issued: Dec. 16, 1941

A lock comprising a tubular sleeve provided with an internal screw thread, axially alined separate lock barrels and a plug positioned in and rotatable relative to said sleeve, a first of said lock barrels having a peripheral screw thread meshing with said internal screw thread of the sleeve, a pair of spaced guide rods secured at their ends in said plug and a second of said lock barrels, said first of the lock barrels being in slidable engagement with said guide rods, setscrews in said sleeve and engaging said second of the lock barrels for securing the latter and the sleeve against relative rotation, a rotor comprising separate cylindrical sections journaled respectively in said first and second lock barrels and in said plug, a pair of spaced second guide rods secured at their ends in the rotor sections of said plug and second lock barrel and being in slidable engagement with said first of the lock barrels, tumblers normally locking said rotor and lock barrels together against relative rotation, said rotor sections having alined key way openings, and said tumblers normally projecting into said openings.

U.S. Pat. No. 2,603,081

Inventor: Stephen Pelle

Issued: Jul. 15, 1952

A lock device comprising a hollow cylinder and a plurality of slide assemblies disposed within the hollow cylinder. One of said assemblies being adjustable longitudinal of the cylinder, said cylinder having a slot, and each of said slide assemblies having a slide adapted to be projected into the slot and retracted therefrom. The slide assemblies are adapted to receive a key. A means is carried by the cylinder and connected to the adjustable slide assembly for effecting the adjustment of the slide assembly relative to the other assemblies to render the lock adaptable for a different key. An end plate is connected to the hollow cylinder, and said end plate includes a means rotatable and connectable with the slide assemblies to be adjusted by the same. The means for adjusting the adjustable slide assembly comprises a plurality of adjustable members circumferentially spaced from one another. The hollow cylinder has longitudinally extending openings, and the adjustable members are slidable in said openings and engageable with the adjustable slide assembly. A plurality of screws is connected respectively with the adjustable members to move the same. A large gear is located on the end plate and journaled thereabout. Pinion gears mesh with the large gear and are respectively connected to the screws to simultaneously operate the same and to effect the adjustment of the adjustable slide assembly.

U.S. Pat. No. 3,261,188

Inventor: William J. Kerr

Issued: Jul. 19, 1966

In an axial pin tumbler lock assembly, in combination, an open-ended, non-rotatable tubular barrel having an axial bore and annular front and rear end faces, a lock shaft rotatable within said bore and having an enlarged head presenting a rear end face in rotative sliding contact with said front end face of the barrel, an axial split pin tumbler arrangement including cooperating barrel and shaft pins, said shaft pins projecting forwardly of the head for cooperation with a key and being freely removable endwise from the shaft head for purposes of pin interchange, a forwardly and axially removable annular cap positioned forwardly of the barrel and encircling said shaft head, fixed interengaging means on the cap and barrel preventing rotation of the cap, said shaft being rotatable from a first angular unlocked position, through a second angular locked position, to a third overrun terminal position, slidable interengaging means on the cap and shaft head normally preventing removal of the cap, said slidable interengaging means permitting forward removal of the cap when the lock shaft is in its terminal position, a collar-like latch member mounted on and rotatable with the lock shaft rearwardly of the barrel and including an axially shiftable latch pin yieldingly and slidingly bearing against the rear end face of said barrel, first, second and third spaced shoulders on said rear end face of the barrel engageable by the latch pin to determine said first, second and terminal positions of the lock shaft respectively, there being access openings in said cap and barrel in axial alignment with said latch pin when the latter is in position against said second shoulder to permit depression of the latch pin by a suitable pin-like tool and consequent withdrawal of the latch pin from said second shoulder to allow the lock shaft to be moved to its terminal position.

U.S. Pat. No. 4,372,139

Inventor: Dennis L. Laake

Issued: Feb. 8, 1983

A lock in which a replaceable control shaft adjusts a moveable shaft in the main cylinder to different predetermined levels. By adjusting the moveable shaft a new shear line is created between the key pin housed in the shaft and the spring loaded pin tumbler housed in a separate moveable shaft embodied in the lock housing. When a new shear line has been created a new predetermined key will become operable while the prior key, unless it is a master key, becomes inoperable. A special key when rotated causes a cylinder to rotate creating a cavity in the lock allowing access to the control shaft through the facing of the lock. The control shaft has a spring that compresses upon adjustment securing a nodule on the control shaft into one of several cavity slots. The control shaft has teeth that mesh into the adjustable moveable shaft. The teeth may or may not cause the moveable shaft to change position upon the rotation of the control shaft. The bridging device connects the main cylinder and the sloped upper portion of the adjustable moveable shaft. This bridge slides under and raises the upper moveable shaft into an aligning position with the adjustable moveable shaft thereby preventing jamming when the main cylinder is returned to its original position.

U.S. Pat. No. 4,850,210

Inventor: Richard S. Adler

Issued: Jul. 25, 1989

A lock which is rekeyable or programmable to operate with a different key from the exterior thereof without disassembling it or removing it from a lock assembly in which it is assembled is disclosed. The lock is rekeyed by a change key through the keyway so that the lock appears from the exterior thereof to be a conventional lock. The change key which can not operate the lock adjusts a movable shear line formed by what is in effect an externally adjustable tumbler. The lock includes a plurality of pin tumbler sets and a plurality of cylinders disposed one in the other in the lock casing. The pin tumbler sets and the cylinders cooperate to form a plurality of common pin tumbler shear lines, i.e., shear lines formed by a number of individual shear lines of individual pin tumbler sets. In a given position of the adjustable shear line, only one of the keys will position the pin tumblers to form the proper common pin tumbler shear which is aligned with the adjustable shear line to operate the lock. The rekeying structure of the lock is passive and its presence is not noticed when operating the lock. The lock also includes structure which indicates that the adjustable shear line is in one of the positions with which a common tumbler shear line may be aligned. The lock further includes a structure which locks the adjustable shear line in a given position.

U.S. Pat. No. 4,912,953

Inventor: Gerald C. Wobig

Issued: Apr. 3, 1990

A cylinder lock is adapted to be re-keyed by a change key which, incident to turning a plug in a cylinder, transversely shifts a shuttle of the cylinder. The shuttle carries three sets of drive and master pins which may be selectively brought into active position relative to the plug by shifting the shuttle transversely.

U.S. Pat. No. 5,325,690

Inventor: Richard S. Adler et al.

Issued: Jul. 5, 1994

A lock which is rekeyable or programmable to operate with a different key from the exterior thereof without disassembling it or removing it from a lock assembly in which it is assembled is disclosed. The lock may be rekeyed through the keyway so that the lock appears from the exterior thereof to be a conventional lock, or from the end opposite the keyway from the interior of a door, or from a side of the lock which requires disassembly of the lock from its lock assembly. The lock includes structure defining a movable shear line that can be adjusted from the exterior of the lock without disassembling the lock itself. Such structure may comprise a rotatable cam and a pin tumbler and an axially adjustable set screw. Security of the lock is improved by selectively restricting or blocking access to the rekeying of the lock in the interior thereof with a gate or shutter, or various combinations of gates or shutters.

U.S. Pat. No. 5,819,569

Inventor: Rodrick A. Herdman

Issued: Oct. 13, 1998

A lock with changeable warding positions wherein a rotationally indexable warding member selectively enables one of a multiple of keys for operation of the lock.

U.S. Pat. No. 5,921,121

Inventor: Xu Fai Tang

Issued: Jul. 13, 1999

The present apparatus provides an adjustable key-type spring pin lock cylinder. The spring pin lock cylinder includes a lock core (1), a first core sleeve (2), and a second core sleeve (3). At the rear section of the lock core, two depressions, each with a countersink on one side, are made. Two steel balls (4) are respectively placed into the depressions. On the rear cover (5) of the lock, there are two through-holes in which the press rods (6) and the springs (7) are placed. By turning the adjusting lever (10) on the supporting stand (9), either key may be selected to open the lock or only one of the two keys can open the lock.

U.S. Pat. No. 6,119,495

Inventor: Alberto Lorenti

Issued: Sep. 19, 2000

A programmable cylinder lock that is operable with a first key and a first master key having a different shape than the first key, and that is programmable so that the lock is no longer operable with the first key or the first master key. The reprogrammed lock is operable with a second key having a shape different from the first key and with a second master key having a shape different from the first master key.

U.S. Pat. No. 6,776,017

Inventor: Rodrick A. Herdman

Issued: Aug. 17, 2004

An adaptable lock 10 assembly and a method of using the lock 10 assembly in order to reprogram a lock 10 to accept a key different from the key which originally operated the lock 10. The lock 10 assembly includes a housing 12 with a bore 14 disposed through the housing 12 and a plug 16 rotatably mounted in the bore 14. The plug 16 includes at least one radial slot 18 which is disposed in the plug 16 along the circumference of the plug 16. The plug 16 further includes a longitudinal slot used as a keyway 22 which is adapted to receive a key. The assembly further includes first and second radial tumblers 30, 32 which are disposed in the radial slot 18 and are capable of being in an engaged or disengaged relationship. The distal ends of the first and second radial tumblers 30, 32 extend into the keyway 22 to provide a pattern of ridges along the longitudinal inner walls of the keyway 22. When the first and second radial tumblers 30, 32 are engaged in a first position, a first key 24 fits the lock 10. The first and second radial tumblers 30, 32 may be disengaged in order to reprogram the lock 10 to a second key 44.

U.K. Patent Number 27,080

Inventor: John George Horsey

Issued: Sep. 12, 1905

Constructing locks with bolts carrying one or more segments capable of being affixed to the bolt and each having a projecting lug, one or more slotted sliding plates coincident with the segments, spring controlled tumblers operating the sliding plates on movement by the key, the segments being adjustable as to position for their lugs to coincide with the slots in the sliding plates when such sliding plates are positioned by the tumblers when actuated by a key, for the purpose of rendering the lock suitable for various sizes of keys, substantially as set forth.

Bulgarian Patent Number BG63512

Inventor: Alberto Loreti

Issued: Jun. 27, 2002

A programmable cylindrical lock has a stator having a hole, rotor installed in the stator hole, which has a hole for the key, programming mechanism, which in the process of operation of replacement makes it possible to reprogram the lock for operation with a key different from the one used previously, and at least one closing pin or-counter-pin that is divided into a minimum of two parts and can be displaced to the open position by a minimum of two keys of a different shape. The programming mechanism has in the stator at least a single longitudinal duct made in the hole, optionally including a group of stator seats and closing counter-pins and springs, and in the rotor it has a group of the first seats, which intersect the hole for the key, and a group of the second seats parallel to the first seats. The effect of the programmable lock is an enhanced convenience in use.

While these locks may be suitable for the purposes for which they were designed, they would not be as suitable for the purposes of the present invention, as hereinafter described.

SUMMARY OF THE PRESENT INVENTION

The present invention relates generally to locks and, more specifically, to a rekeyable lock having a plurality of pin tumbler combinations that are user selective. Pin tumbler combinations are positioned around the keyway plug and allow any of the preset combinations to be selected. Accordingly, a key mating to each pin tumbler combination is required. To select a different pin tumbler combination, a master key is inserted into the keyway to enable rotation of an outer sleeve about the keyway plug thereby positioning a new set of pins into the keyway. The present invention allows the holder of the master key to change the lock without actually replacing the lock.

A primary object of the present invention is to provide a rekeyable lock that overcomes the shortcomings of the prior art.

Another, secondary object of the present invention is to provide a rekeyable lock having a plurality of selectable pin tumbler combinations.

Another object of the present invention is to provide a rekeyable lock wherein the plurality of pin tumbler combinations has a mating key.

Yet another object of the present invention is to provide a rekeyable lock wherein the mating keys are uniquely distinct from one another.

Still yet another object of the present invention is to provide a rekeyable lock wherein the lock includes a lock plug having concentrically located inner and outer sleeves.

A further object of the present invention is to provide a rekeyable lock wherein the lock plug can be selectively rotated to a different pin tumbler selection.

Another object of the present invention is to provide a rekeyable lock wherein an inner and an outer sleeve include the pin tumblers.

Yet another object of the present invention is to provide a rekeyable lock wherein a pin tumbler is a particular configuration of a plurality pins.

Another object of the present invention is to provide a rekeyable lock wherein the inner sleeve has a plurality of bores extending therethrough in transversal rows.

Yet another object of the present invention is to provide a rekeyable lock wherein the outer sleeve has a plurality of bores extending therethrough aligned in transversal rows with the bores of the inner sleeve.

Still yet another object of the present invention is to provide a rekeyable lock wherein the lock extends the life of the lockset.

Another object of the present invention is to provide a rekeyable lock wherein the lock permits selection of a new pin tumbler configuration and valid key.

A further object of the present invention is to provide a rekeyable lock that is simple and easy to use.

A still further of the present invention is to provide a rekeyable lock that is economical in cost to manufacture.

Additional objects of the present invention will appear as the description proceeds.

The present invention overcomes the shortcomings of the prior art by providing a rekeyable lock having a plurality of pin tumbler combinations that are user selective. The lock of the present invention includes a plurality of pin tumbler combinations that are radially positioned around the keyway plug. The lock allows a user to select and move a desired one of the pin tumblers into the keyway. Accordingly, a key mating to each selectable pin tumbler combination is provided to lock and unlock each pin tumbler combination. To select a different pin tumbler combination, a master key is inserted into the keyway to enable rotation of the outer sleeve about the keyway plug positioning a new set of pins into the keyway.

The foregoing and other objects and advantages will appear from the description to follow. In the description reference is made to the accompanying drawings, which forms a part hereof, and in which is shown by way of illustration, specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
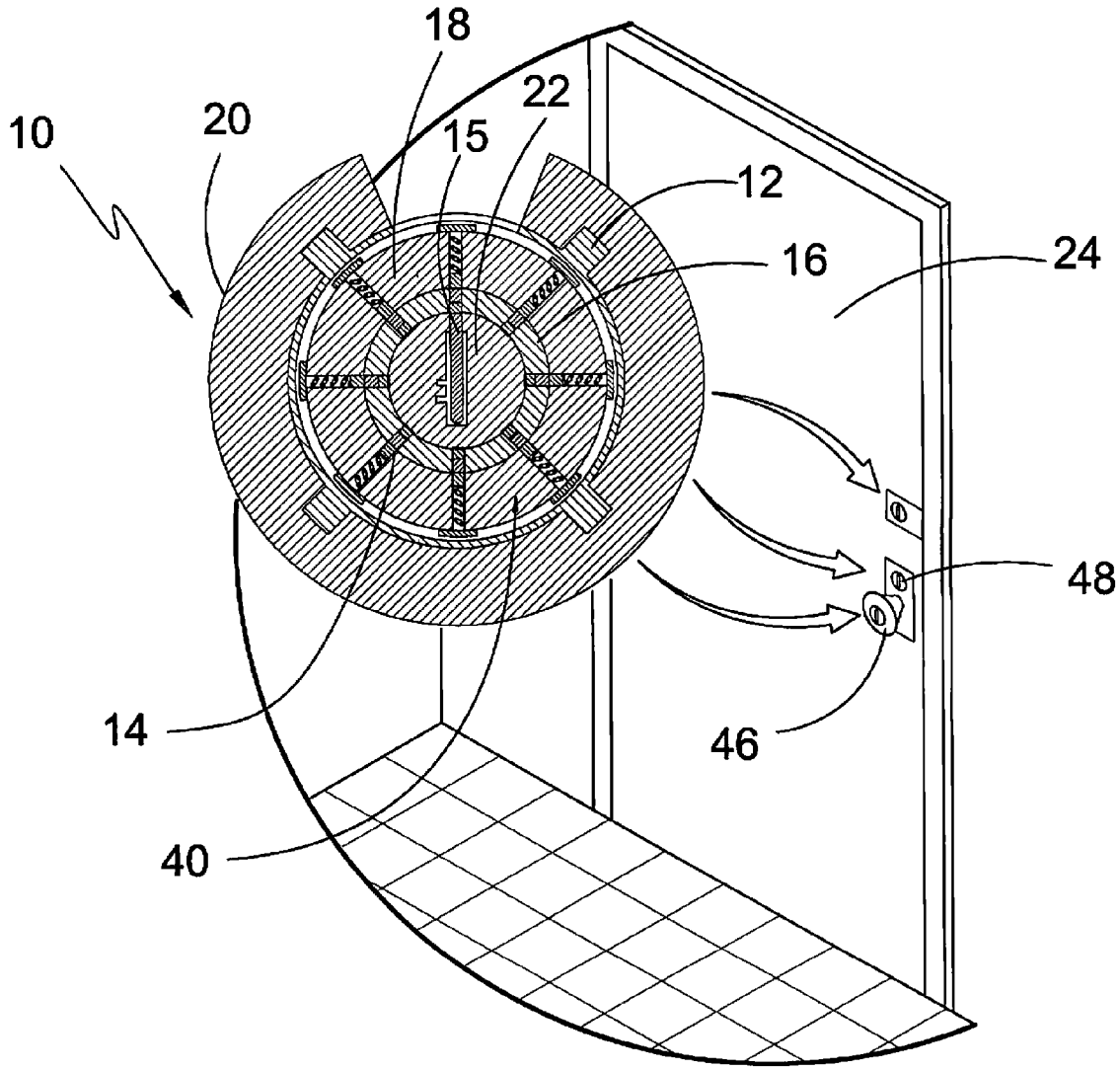
FIG. 1 is an illustrative view of the rekeyable lock of the present invention in use.

Turning now descriptively to the drawings, in which similar reference characters denote similar elements throughout the several views, the Figures illustrate the rekeyable lock of the present invention. With regard to the reference numerals used, the following numbering is used throughout the various drawing figures.

10 rekeyable lock mechanism of the present invention
12 housing
14 sleeve pin sets
15 core pin sets
16 inner sleeve
17 springs
18 outer sleeve
19 sleeve pin covers
20 mounting bracket
21 screws
22 lock core
24 door
28 key hole
30 face plate
32 rear plate
34 cover plate
36 retaining ring
38 pin release
40 lock cylinder
42 preset apertures
46 door handle
48 door handle frame

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments; practitioners skilled in the art will recognize numerous other embodiments as well. For definition of the complete scope of the invention, the reader is directed to appended claims.

Turning now descriptively to the drawings, in which similar reference characters denote similar elements throughout the several views, FIGS. 1 through 6 illustrate a rekeyable lock mechanism of the present invention which is indicated generally by the reference numeral 10.

FIG. 1 is an illustrative view of the rekeyable lock mechanism 10 of the present invention in use, hereinafter referred to as the "lock mechanism". Shown herein, three locks 10 are positioned within a door 24 to allow the door 24 to be locked and unlocked. The lock mechanism 10 can be located in a plurality of positions on the door 24. Herein, identical lock mechanisms 10 are located within the door handle 46, within the frame surrounding the door handle 48, and within the door 24 itself. The lock mechanism 10 has a housing 12, sleeve pin sets 14, core pin sets 15, an inner sleeve 16, an outer sleeve 18, a mounting bracket 20, and a lock core 22. The lock core 22 has the inner sleeve 16 positioned therearound and the outer sleeve 18 is positioned around the inner sleeve 16. The housing 12 is positioned around the outer sleeve 18. The mounting bracket 20 contains the housing 12 and is attached within the door 24.

The lock mechanism 10 is a pin and tumbler lock whereby one of a plurality of rows of sleeve pin sets 14 can be selectively positioned in a keyway. Each pin set formation requires a key specifically mated to that formation to be inserted into the look cylinder 40 to unlock the lock mechanism 10. However, the lock mechanism 10 also includes a master key receivable within the lock cylinder 40 for unlocking all pin formations. Additionally when the master key is inserted into the lock cylinder 40, the lock cylinder 40 may be removed from its housing 12 to make the changing the pin formation of the lock mechanism 10 accessible. To change the lock mechanism 10, a lever is used to move one of the plurality of rows of sleeve pin sets 14 into the operative position.

Figure 2:
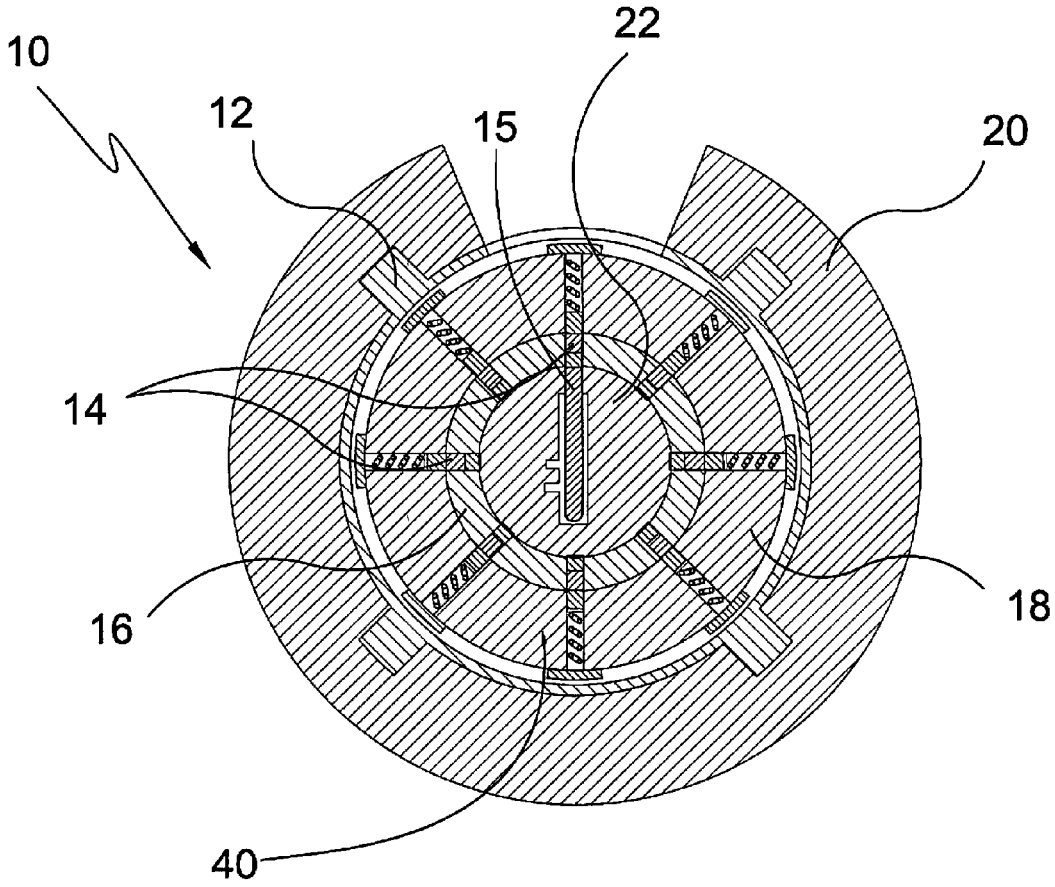
FIG. 2 is a planar view of the back end of the key cylinder of the rekeyable lock of the present invention.

FIG. 2 is a planar view of the back end of the key cylinder of the lock mechanism 10 of the present invention. The lock mechanism 10 has a housing 12, sleeve pin sets 14, core pin sets 15, an inner sleeve 16, an outer sleeve 18, a mounting bracket 20, and a lock core 22. The lock core 22 has the inner sleeve 16 positioned therearound and the outer sleeve 18 is positioned around the inner sleeve 16. The outer sleeve 18 and the inner sleeve 16, which when assembled together, are referred to as the lock cylinder 40. The housing 12 is positioned around the outer sleeve 18. The mounting bracket 20 contains the housing 12 and is attached to the door 24, shown in FIG. 1.

The lock mechanism 10 is a pin and tumbler lock whereby one of a plurality of rows of sleeve pin sets 14 can be selectively positioned in a keyway. Embedded in the lock cylinder 40 is a plurality of rows extending through and along a length of each of the inner sleeve 16 and outer sleeve 18 forming preset apertures 42 which receive the sleeve pin sets 14, shown in FIG. 5. The orientation of the sleeve pin sets 14 in the preset apertures 42 will hereinafter be referred to as the pin set formation. Each pin formation requires a key specifically mated to that formation to be inserted into the lock cylinder 40 to unlock the lock mechanism 10. However, the lock mechanism 10 also includes a master key receivable within the lock cylinder 40 for unlocking all pin formations. Additionally when the master key is inserted into the lock cylinder 40, the lock cylinder 40 may be removed from its housing 12 to make changing the pin formation of the lock mechanism 10 accessible.

To change the pin set formation and thereby change the key require to unlock the lock mechanism 10, a master key is used to remove the lock cylinder 40 and then a lever is used to rotate the lock cylinder 40 in a clockwise direction. The lock cylinder 40 is rotated to one of a plurality of pin set formations and the internal lock mechanism will turn and mechanically adjust to act the key that corresponds to that pin set formation.

Figure 3:
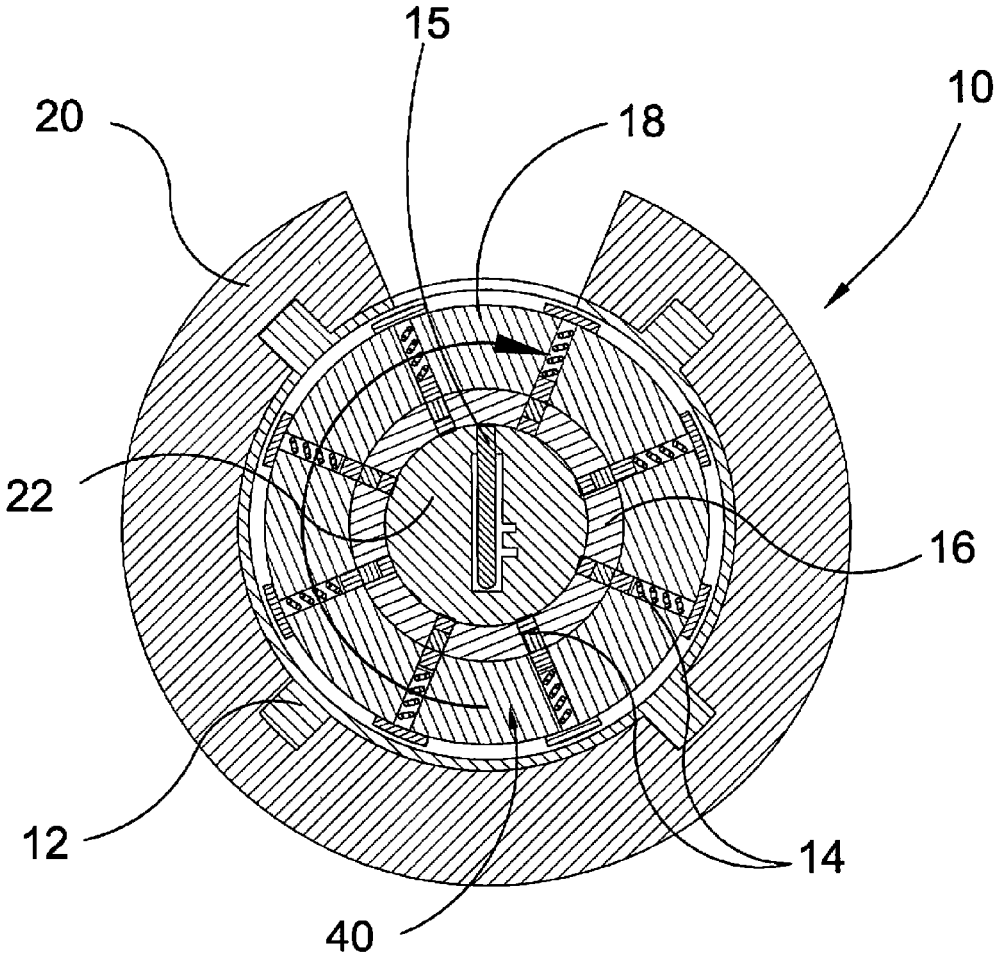
FIG. 3 is a planar view of the back end of the key cylinder of the rekeyable lock of the present invention.

FIG. 3 is a planar view of the back end of the key cylinder of the lock mechanism 10 of the present invention. The lock mechanism 10 has a housing 12, sleeve pin sets 14, core pin sets 15, an inner sleeve 16, an outer sleeve 18, a mounting bracket 20, and a lock core 22. The lock core 22 has the inner sleeve 16 positioned therearound and the outer sleeve 18 is positioned around the inner sleeve 16. The outer sleeve 18 and the inner sleeve 16, which when assembled together, are referred to as the lock cylinder 40. The housing 12 is positioned around the outer sleeve 18. The mounting bracket 20 contains the housing 12 and is attached to the door 24, shown in FIG. 1.

As shown in FIG. 2, to change the pin set formation and thereby change the key that will fit the lock mechanism 10, a master key is used to remove the lock cylinder 40 and then a lever is used to rotate the lock cylinder 40 in a clockwise direction. The lock cylinder 40 is rotated in a clockwise direction to one of a plurality of pin set formations and the internal lock mechanism will turn and mechanically adjust to accept the key that corresponds to that pin set formation.

Figure 4:
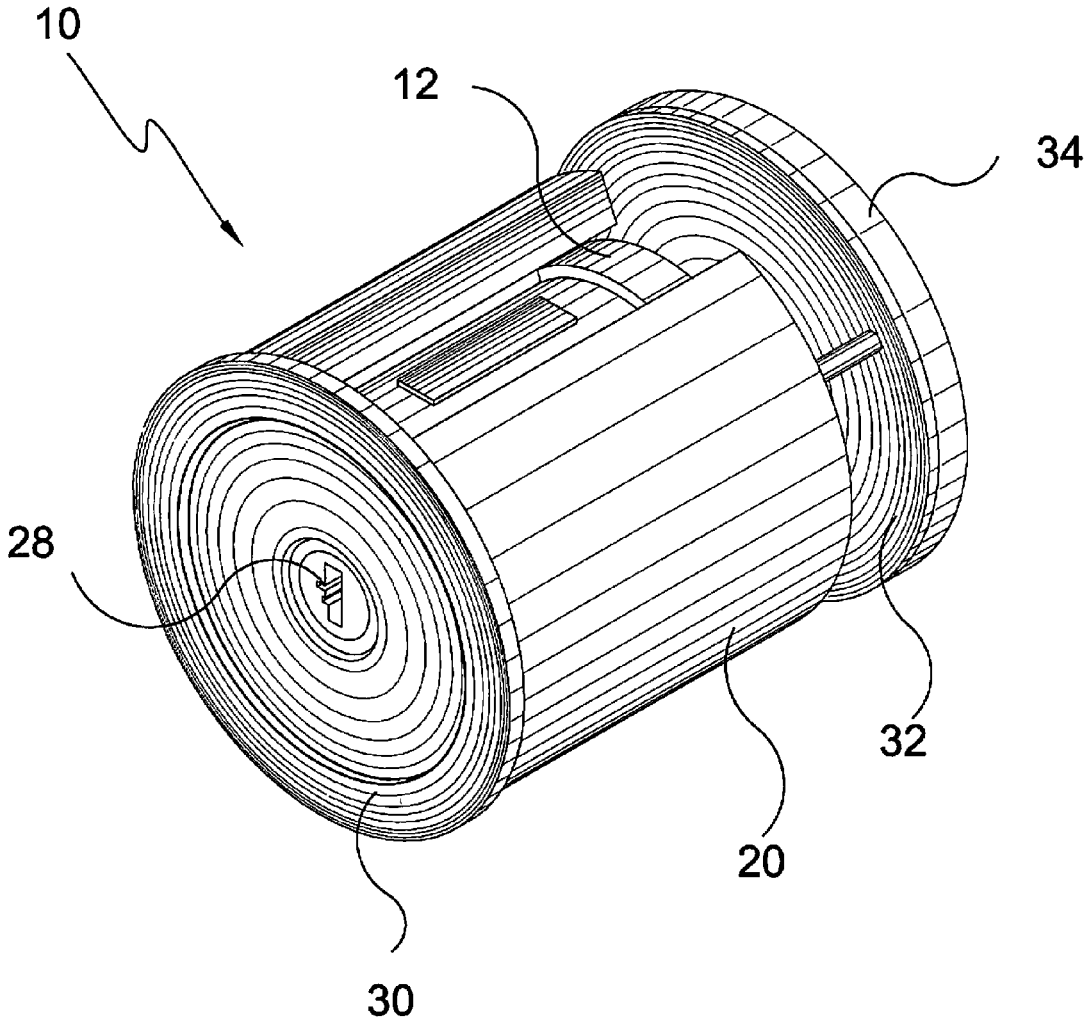
FIG. 4 is a perspective view of the rekeyable lock of the present invention.

FIG. 4 is a perspective view of the lock mechanism 10 of the present invention. Shown herein is the lock mechanism 10 fully assembled as it would be in a door 24 as in FIG. 1 whereby the mounting bracket 20 is fit within an aperture of the door to securely hold the lock mechanism 10 therein. The mounting bracket 20 has a first end and a second end. Attached to the first end of the mounting bracket 20 is a face plate 30, which is visible on the external surface of the door 24. The face plate 30 has an aperture through which a key hole 28 is visible and accessible. Attached to the second end of the mounting bracket 20 is a rear plate 32. A cover plate 34 covers the rear plate 32 to prevent tampering with the lock mechanism. To change the pin set formation and thereby change the key that will fit the lock mechanism 10, a master key is inserted into key hole 28 and turned counter clockwise thereby allowing the lock cylinder 40 to be extracted. After removal, a lever is used to rotate the lock cylinder 40 in a clockwise direction to the desired pin set formation.

Figure 5:
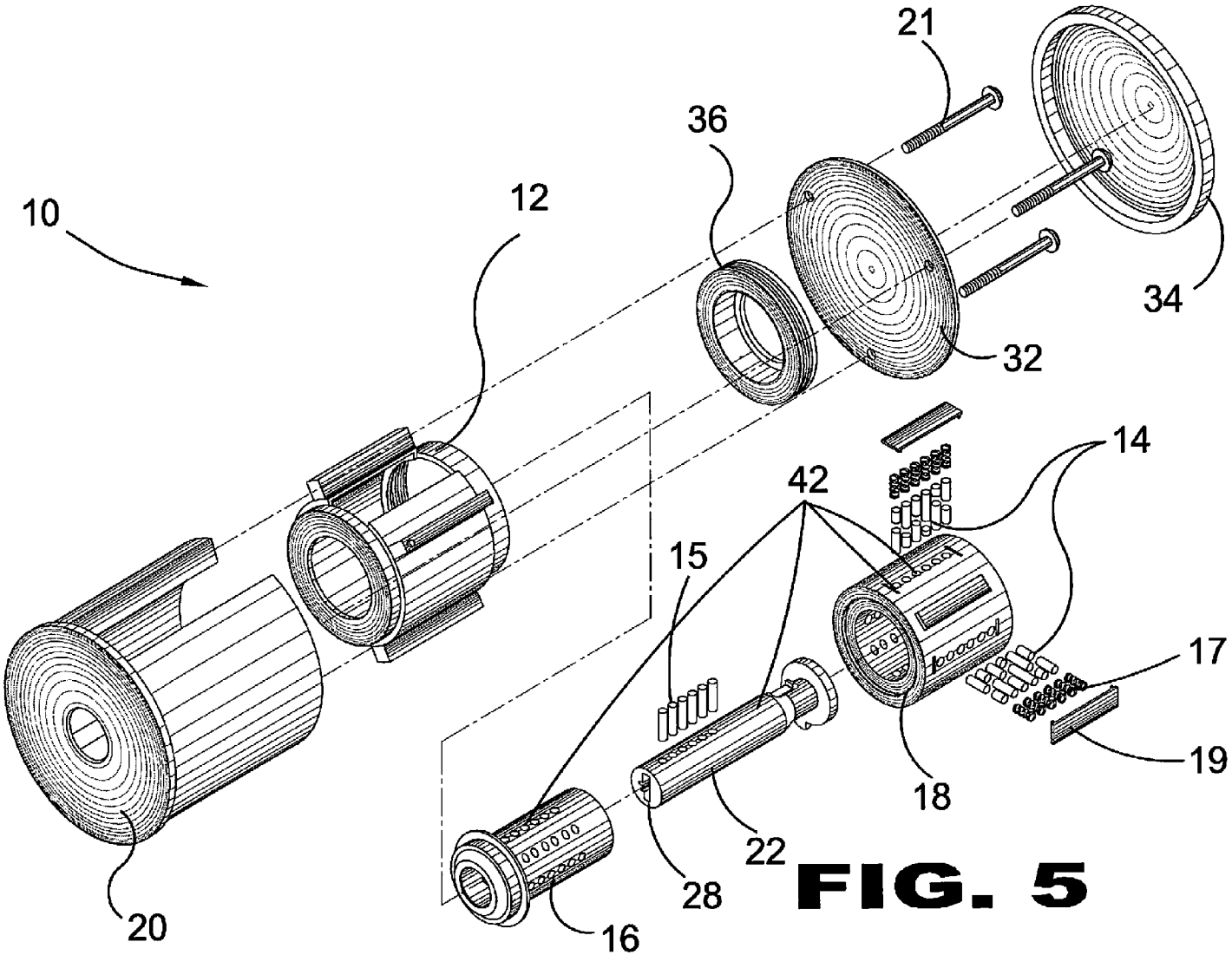
FIG. 5 is an exploded view of the rekeyable lock of the present invention.

FIG. 5 is an exploded view of the lock mechanism 10 of the present invention. Shown is the lock mechanism 10 exploded into its individual components including a lock core 22 and a plurality of sleeves 16 and 18. The sleeves 16 and 18 contain aligned preset apertures 42 for receiving pin sets formations. The pin set formations are made from a plurality of sleeve pin sets 14. The sleeve pin sets 14 may be selectively positioned to create varying placements of break lines within the lock mechanism 10, allowing for multiple lock settings to be contained within a single lock assembly 10.

The lock core 22 is cylindrically shaped and has a plurality of preset apertures 42 for receiving core pin sets 15. The lock core 22 also has a key hole 28 for receiving at least one of a key and a masterkey therein. The lock core 22 is positioned within a bore extending through the inner sleeve 16. The inner sleeve 16 is cylindrically shaped and has a plurality of preset apertures 42 for receiving sleeve pin sets 14. The inner sleeve 16 is positioned within a bore extending through the outer sleeve 18. The outer sleeve 18 is cylindrically shaped and has a plurality of preset apertures 42 for receiving a respective one of the plurality of the sleeve pin sets 14. The sleeve pin sets 14 pass through the preset apertures 42 in both the outer sleeve 18 and the inner sleeve 16. Each sleeve pin set 14 is formed from two different length pins, however, the total length of each set is equal to the length of the pins forming the other pin sets 14. Each set has a first end and a second end. The first end of the set passes through the outer sleeve 18 and the inner sleeve 16 and rests within the inner sleeve 16. The second end of the set extends into the outer sleeve 18 and may partially extend into the inner sleeve 16 depending on the length thereof. Springs 17 are received within respective apertures of the outer sleeve 18 and are adjacent to the second end of the respective sleeve pin sets 14. Sleeve pin covers 19 prevent the sleeve pin sets 14 and the springs 17 from falling out of the lock assembly 10.

The outer sleeve 18 is inserted within the cylindrically shaped housing 12. The housing 12 is located within the cylindrically shaped mounting bracket 20. Located between the housing 12 and a rear plate 32 is a retaining ring 36 for securing the housing 12. The housing 12 and the retaining ring 36 are positioned within the mounting bracket 20. The rear plate 32 covers the back of the mounting bracket 20. The rear plate 32 is attached to the mounting bracket 20 by a plurality of screws 21 passing through a plurality of corresponding apertures. The rear plate 32 is covered by the cover plate 34 to prevent tampering with the locking mechanism 10.

Figure 6:
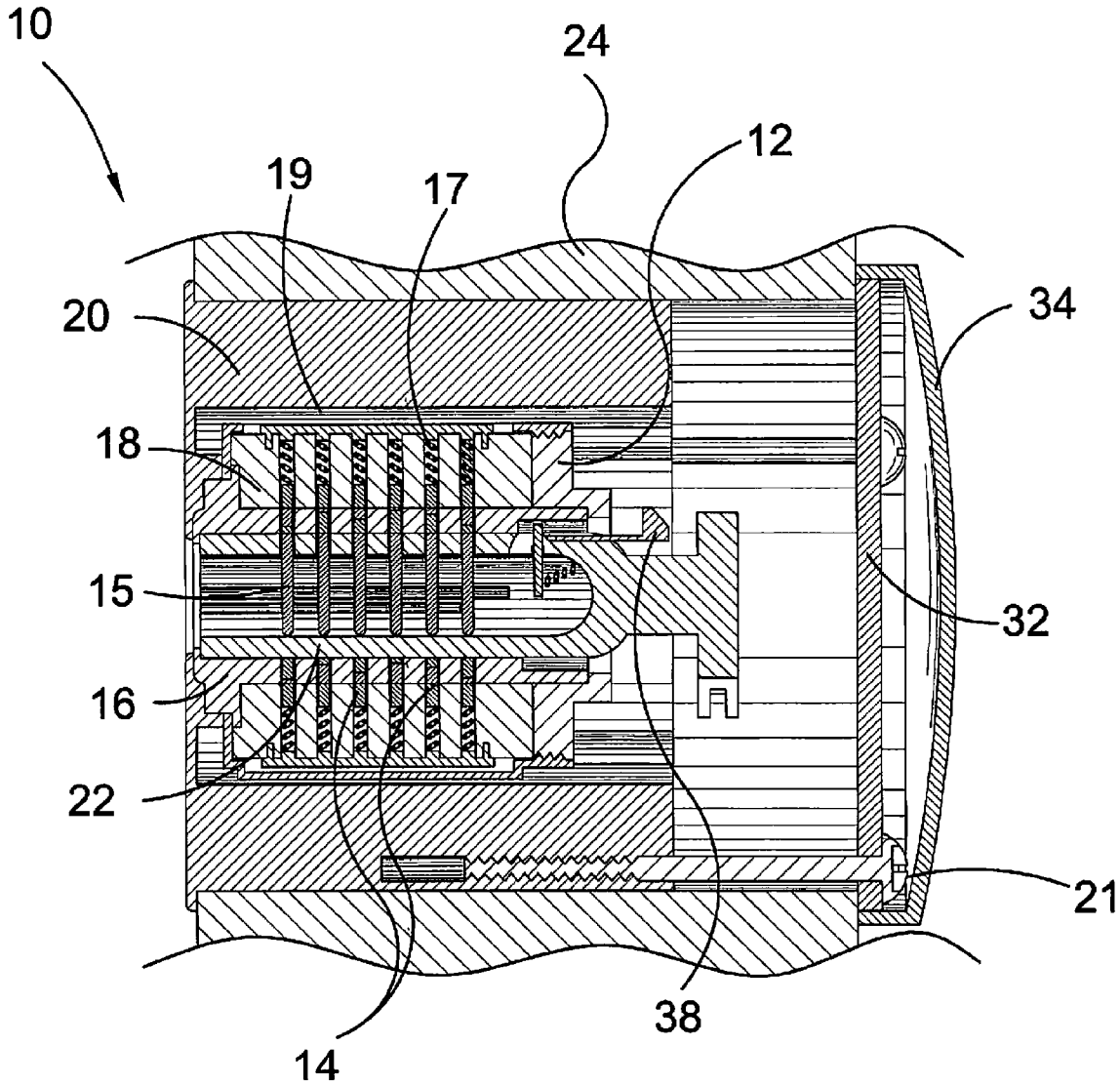
FIG. 6 is a cross sectional view of the rekeyable lock of the present invention.

FIG. 6 is a cross sectional view of the lock mechanism 10 of the present invention. Shown herein is the lock mechanism 10 having a plurality of sleeves 16 and 18 that work in cooperation with a plurality of pin sets 14 with each pin set having a plurality of differently sized pins to allow the user to simply rotate the outer 18 and inner sleeve 16 to change the lock setting. The entire lock mechanism 10 is encapsulated in the mounting bracket 20.

The lock core 22 is cylindrically shaped and has a plurality of preset apertures 42 for receiving core pin sets 15. The lock core 22 also has a key hole 28 for receiving at least one of a key and a masterkey therein. The lock core 22 is positioned within a bore extending through the inner sleeve 16. The inner sleeve 16 is cylindrically shaped and has a plurality of preset apertures 42 for receiving sleeve pin sets 14. The inner sleeve 16 is positioned within a bore extending through the outer sleeve 18. The outer sleeve 18 is cylindrically shaped and has a plurality of preset apertures 42 for receiving a respective one of the plurality of the sleeve pin sets 14. The sleeve pin sets 14 pass through the preset apertures 42 in both the outer sleeve 18 and the inner sleeve 16. Each sleeve pin set 14 is formed from two different length pins, however, the total length of each set is equal to the length of the pins forming the other pin sets 14. Each set has a first end and a second end. The first end of the set passes through the outer sleeve 18 and the inner sleeve 16 and rests within the inner sleeve 16. The second end of the set extends into the outer sleeve 18 and may partially extend into the inner sleeve 16 depending on the length thereof. Springs 17 are received within respective apertures of the outer sleeve 18 and are adjacent to the second end of the respective sleeve pin sets 14. Sleeve pin covers 19 prevent the sleeve pin sets 14 and the springs 17 from falling out of the lock assembly 10.

The outer sleeve 18 is inserted within the cylindrically shaped housing 12. The housing 12 is located within the cylindrically shaped mounting bracket 20. Located between the housing 12 and a rear plate 32 is a retaining ring 36 for securing the housing 12. The housing 12 and the retaining ring 36 are positioned within the mounting bracket 20. The rear plate 32 covers the back of the mounting bracket 20. The rear plate 32 is attached to the mounting bracket 20 by a plurality of screws 21 passing through a plurality of corresponding apertures. The rear plate 32 is covered by the cover plate 34 to prevent tampering with the locking mechanism 10.

To change the pin set 14 formation, a master key is inserted into the lock core 22 and turned counter clockwise. Turning the master key counterclockwise triggers a pin release 38 which allows the lock cylinder 40 to be rotated to change the pin set formation.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A lock apparatus able to be installed in a structure comprising:

a) an outer sleeve having a plurality of outer rows extending transversely therethrough and radially therearound and a first bore extending though substantially a center thereof;

b) an inner sleeve having a second bore extending through substantially a center thereof and releasably connected within said first bore, said inner sleeve having a plurality of inner rows extending therethrough wherein each respective inner row is aligned with a respective one of said plurality of outer rows, said inner and outer sleeves together forming a lock cylinder;

c) a plurality of user selectable sleeve pin sets positioned within said plurality of outer and inner rows;

d) a lock core for receiving a key therein releasably connected within said second bore having a plurality of core pin sets in a single row aligned with any one of said sleeve pin sets;

e) an unlocking key for each of said sleeve pin sets; and t) a master key for removing said lock core from said lock cylinder ewe for rotating said outer sleeve with respect to said inner sleeve to align another row of sleeve pin sets with said core pin sets in said lock core whereby returning said lock core to said lock cylinder requires another unlocking key to open said lock apparatus.

2. The apparatus as recited in claim 1, further comprising a housing for retaining said apparatus therein.

3. The apparatus as recited in claim 2, wherein said housing allows said apparatus to be mounted within each of a door, a door handle and a door handle plate.

4. The apparatus as recited in claim 1, having a pin release which is triggered by said master key to allow said lock cylinder to be removed for changing alignment of the sleeve pin sets.

5. The apparatus as recited in claim 4, wherein said release switch is a lever.

6. The apparatus as recited in claim 5, wherein each of said sleeve pin sets is formed from a plurality of pins each pin having formed by two different sized pin members aligned vertically with one another.

7. The apparatus as recited in claim 6, wherein said active pin formulation are changeable without removing said apparatus from said structure.

8. The apparatus as recited in claim 7, further comprising a lace plate selectively positionable over each of said lock cylinder, said inner sleeve and said outer sleeve thereby revealing an opening of said lock cylinder, for receipt of a key therethrough.

9. The apparatus as recited in claim 8, further comprising a rear plate positioned on a side of said housing opposite said face plate.

10. A method for changing a lock comprising the steps of:

a) Selecting a first active pin formulation for use in opening the lock comprising:

i) an outer sleeve within an outer cylinder having a plurality of outer rows extending transversely therethrough and radially therearound and a first bore extending though substantially a center thereof, ii) an inner sleeve having a second bore extending through substantially a center thereof and releasably connected within the first bore, the inner sleeve having a plurality of inner rows extending therethrough wherein each respective inner row is aligned with a respective one of the plurality of outer rows, said inner and outer sleeves together forming a lock cylinder;

iii) a plurality of user selectable sleeve pin sets positioned within the plurality of outer and inner rows; and iv) a lock core releasably connected within said second bore having a plurality of core pin set sets in a single row for receiving a key therein aligned with any one of said sleeve pin sets;

b) inserting a master key into the lock cylinder;

c) engaging a switch with said master key for selectively releasing said lock cylinder and core from the outer cylinder;

d) rotating the outer sleeve to change the orientation of the plurality of outer rows thereby causing another set of sleeve pin sets to be aligned with said core pin sets to he used as the active pin formulation;

e) inserting the inner sleeve within the bore of the outer sleeve and securing the inner sleeve therein; and f) inserting the lock core within the bore of the inner sleeve and securing therein thereby changing a key required to open the lock.

* * * * *